US008375751B2

(12) United States Patent
Hacker

(10) Patent No.: US 8,375,751 B2
(45) Date of Patent: Feb. 19, 2013

(54) LOCKABLE ENCLOSURE

(75) Inventor: Dean D. Hacker, Oak Creek, WI (US)

(73) Assignee: Master Lock Company LLC, Oak Creek, WI (US)

( * ) Notice: Subject to any disclaimer, the term of this patent is extended or adjusted under 35 U.S.C. 154(b) by 241 days.

(21) Appl. No.: 12/886,855

(22) Filed: Sep. 21, 2010

(65) Prior Publication Data

US 2011/0067461 A1 Mar. 24, 2011

Related U.S. Application Data

(60) Provisional application No. 61/244,272, filed on Sep. 21, 2009.

(51) Int. Cl.
*E05B 65/52* (2006.01)
*E05B 13/00* (2006.01)

(52) U.S. Cl. ..... 70/63; 70/214; 70/220; 70/298; 70/299; 70/422; 70/DIG. 42; 292/DIG. 27; 292/DIG. 62

(58) Field of Classification Search ..... 70/63, DIG. 42, 70/422, 218–220, 213, 214, 297–300; 292/353, 292/DIG. 27, DIG. 62
See application file for complete search history.

(56) References Cited

U.S. PATENT DOCUMENTS

| | | | | |
|---|---|---|---|---|
| 656,157 | A | | 8/1900 | Alm |
| 1,085,894 | A | | 2/1914 | Eagle |
| 1,092,733 | A | | 4/1914 | McCarthy |
| 1,185,468 | A | | 5/1916 | Borg |
| 1,276,633 | A | | 8/1918 | Forbes |
| 1,423,691 | A | | 7/1922 | Sokolov |
| 1,480,760 | A | | 1/1924 | Hill |
| 1,899,996 | A | * | 3/1933 | Sullivan ..... 70/216 |
| 1,910,125 | A | * | 5/1933 | Root ..... 74/556 |
| 2,029,080 | A | | 1/1936 | Mills |
| 2,109,264 | A | | 2/1938 | Elbaum |
| 2,165,067 | A | | 7/1939 | Pfendner |
| 2,529,119 | A | | 11/1950 | Wallach et al. |
| 2,536,429 | A | | 1/1951 | Dury |
| 2,628,490 | A | | 2/1953 | Klein |
| 2,640,346 | A | | 6/1953 | Giffin |
| 2,665,577 | A | | 1/1954 | Sanowskis |
| 2,706,393 | A | | 4/1955 | Jamieson et al. |

(Continued)

FOREIGN PATENT DOCUMENTS

GB 1497979 1/1978

OTHER PUBLICATIONS

International Search Report and Written Opinion from International Application No. PCT/US2010/059217, date of mailing Feb. 8, 2011.

(Continued)

*Primary Examiner* — Lloyd Gall
(74) *Attorney, Agent, or Firm* — Calfee, Halter & Griswold LLP

(57) ABSTRACT

A locking arrangement includes a latch assembly, a locking mechanism, and a user operable opening member. The locking mechanism holds the latch assembly in a latching position when the locking mechanism is in a locked condition and allows the latch assembly to move to an unlatching position when the locking mechanism is in an unlocked condition. The opening member is movable from a normal position to an opening position. When the locking mechanism is in the unlocked condition, movement of the opening member to the opening position moves the latch assembly from the latching position to the unlatching position. The opening member is operatively connected to the latch assembly by a compressible member, such that when the locking mechanism is in the locked condition, movement of the opening member to the opening position compresses the compressible member without moving the latch assembly out of the latching position.

18 Claims, 9 Drawing Sheets

U.S. PATENT DOCUMENTS

| | | | | |
|---|---|---|---|---|
| 2,785,564 | A | 3/1957 | Rossi | |
| 3,009,346 | A | 11/1961 | Check | |
| 3,040,556 | A | 6/1962 | Rosenhagen | |
| 3,099,150 | A | 7/1963 | Check | |
| 3,115,028 | A | 12/1963 | Windle | |
| 3,115,765 | A | 12/1963 | Fengler | |
| 3,187,528 | A | 6/1965 | Check | |
| 3,357,216 | A | 12/1967 | Cook | |
| 3,379,040 | A | 4/1968 | Shimono | |
| 3,412,587 | A | 11/1968 | Sanowskis | |
| 3,462,981 | A | 8/1969 | Leblanc | |
| 3,667,261 | A | 6/1972 | McGourty | |
| 3,910,078 | A | 10/1975 | Schulz | |
| 3,937,046 | A | 2/1976 | Wang | |
| 4,014,194 | A | 3/1977 | Hartman | |
| 4,027,508 | A | 6/1977 | McGourty | |
| 4,070,881 | A | 1/1978 | Shimono | |
| 4,133,074 | A | 1/1979 | Schack | |
| 4,196,603 | A | 4/1980 | Malacheski et al. | |
| 4,350,031 | A | 9/1982 | Shimono | |
| 4,602,491 | A | 7/1986 | Mauer | |
| 4,627,250 | A | 12/1986 | Kim | |
| 4,671,084 | A | 6/1987 | Lin | |
| 4,748,833 | A | 6/1988 | Nagasawa | |
| 4,766,746 | A | 8/1988 | Henderson | |
| 4,794,768 | A | 1/1989 | Moser et al. | |
| 4,799,371 | A | 1/1989 | Duncan | |
| 4,851,652 | A | 7/1989 | Imran | |
| 4,866,958 | A | 9/1989 | Bretl et al. | |
| 4,936,894 | A | 6/1990 | Larson et al. | |
| 4,952,228 | A | 8/1990 | Taylor et al. | |
| 4,959,978 | A | 10/1990 | Cappell | |
| 5,040,652 | A * | 8/1991 | Fish et al. | 70/189 |
| 5,058,404 | A | 10/1991 | Fish et al. | |
| 5,720,193 | A | 2/1998 | Dick | |
| 5,768,921 | A | 6/1998 | Hill | |
| D411,949 | S | 7/1999 | Hill | |
| 6,000,254 | A | 12/1999 | Raybary | |
| 6,026,665 | A | 2/2000 | Raybary | |
| 6,145,355 | A | 11/2000 | Burleigh et al. | |
| 6,272,889 | B1 | 8/2001 | Burleigh et al. | |
| 6,298,698 | B1 | 10/2001 | Nakajima et al. | |
| 6,334,346 | B1 | 1/2002 | Wang | |
| 6,484,545 | B1 | 11/2002 | Peter et al. | |
| 6,487,803 | B1 | 12/2002 | Yu | |
| 6,575,004 | B2 | 6/2003 | Berton et al. | |
| 6,755,059 | B1 | 6/2004 | Nall | |
| 6,874,339 | B2 | 4/2005 | Segawa | |
| 7,043,948 | B1 | 5/2006 | Wang | |
| 7,100,402 | B2 * | 9/2006 | Holmgren | 70/57.1 |
| 7,316,139 | B2 | 1/2008 | Nakazima et al. | |
| 2003/0126896 | A1 | 7/2003 | Mori | |
| 2003/0179075 | A1 | 9/2003 | Greenman | |
| 2004/0226325 | A1 * | 11/2004 | Ling | 70/63 |
| 2004/0261477 | A1 | 12/2004 | Wang | |
| 2005/0086982 | A1 | 4/2005 | Nakazima et al. | |
| 2005/0210937 | A1 | 9/2005 | Okuda | |
| 2006/0213237 | A1 * | 9/2006 | Yang | 70/63 |
| 2007/0144226 | A1 | 6/2007 | Miao | |
| 2008/0115546 | A1 | 5/2008 | Hu | |
| 2009/0095036 | A1 * | 4/2009 | Ng et al. | 70/63 |

OTHER PUBLICATIONS

International Search Report and Written Opinion from International Application No. PCT/US2010/049615, date of mailing Nov. 4, 2010.

* cited by examiner

LOCKABLE ENCLOSURE

CROSS-REFERENCE TO RELATED APPLICATION

This application claims the benefit of U.S. Provisional Patent Application Ser. No. 61/244,272, entitled LOCKABLE ENCLOSURE and filed Sep. 21, 2009, the entire disclosure of which is incorporated herein by reference, to the extent that it is not conflicting with the present application.

BACKGROUND

Lockable enclosures are used in many indoor and outdoor environments to restrict access to various items by providing the enclosure with a lockable door, lid, drawer, or other such barrier. The barrier can include a locking mechanism, such as, for example, a combination lock, padlock, set of pushbuttons, or key operated latch, to limit access to the contents of the enclosure to one or more authorized users. Some applications may require secure storage of one or more smaller items, such as keys, credit cards, or documents, for which restricted access by a limited number of authorized individuals is desirable. One example of such an enclosure is a key safe, which is affixed to an entry door (e.g., shackled around the doorknob) of a building for secure retention of an authorized key for the entry door. The key safe may employ, for example, a pushbutton or combination dial locking mechanism, such that authorized users informed of the unlocking combination may open the key safe to access the door key for entry into the building.

SUMMARY

The present application contemplates locking arrangement for lockably securing a latch assembly, such as, for example, a latch assembly for a key safe access door, in a latched condition. According to one aspect of the present application, the locking arrangement may include features configured to prevent unauthorized manipulation of the latch assembly by forced movement of a user operable button or lever, by which damage to one or more locking components may otherwise result in movement of the latch assembly.

Accordingly, in one embodiment of the present application, a locking arrangement includes a latch assembly, a locking mechanism, and a user operable opening member. The locking mechanism holds the latch assembly in a latching position when the locking mechanism is in a locked condition and allows the latch assembly to move to an unlatching position when the locking mechanism is in an unlocked condition. The opening member is movable from a normal position to an opening position. When the locking mechanism is in the unlocked condition, movement of the opening member to the opening position moves the latch assembly from the latching position to the unlatching position. The opening member is operatively connected to the latch assembly by a compressible member, such that when the locking mechanism is in the locked condition, movement of the opening member to the opening position compresses the compressible member without moving the latch assembly out of the latching position.

BRIEF DESCRIPTION OF THE DRAWINGS

Further features and advantages of the invention will become apparent from the following detailed description made with reference to the accompanying drawings, wherein.

DETAILED DESCRIPTION OF THE INVENTION

Figure 1:
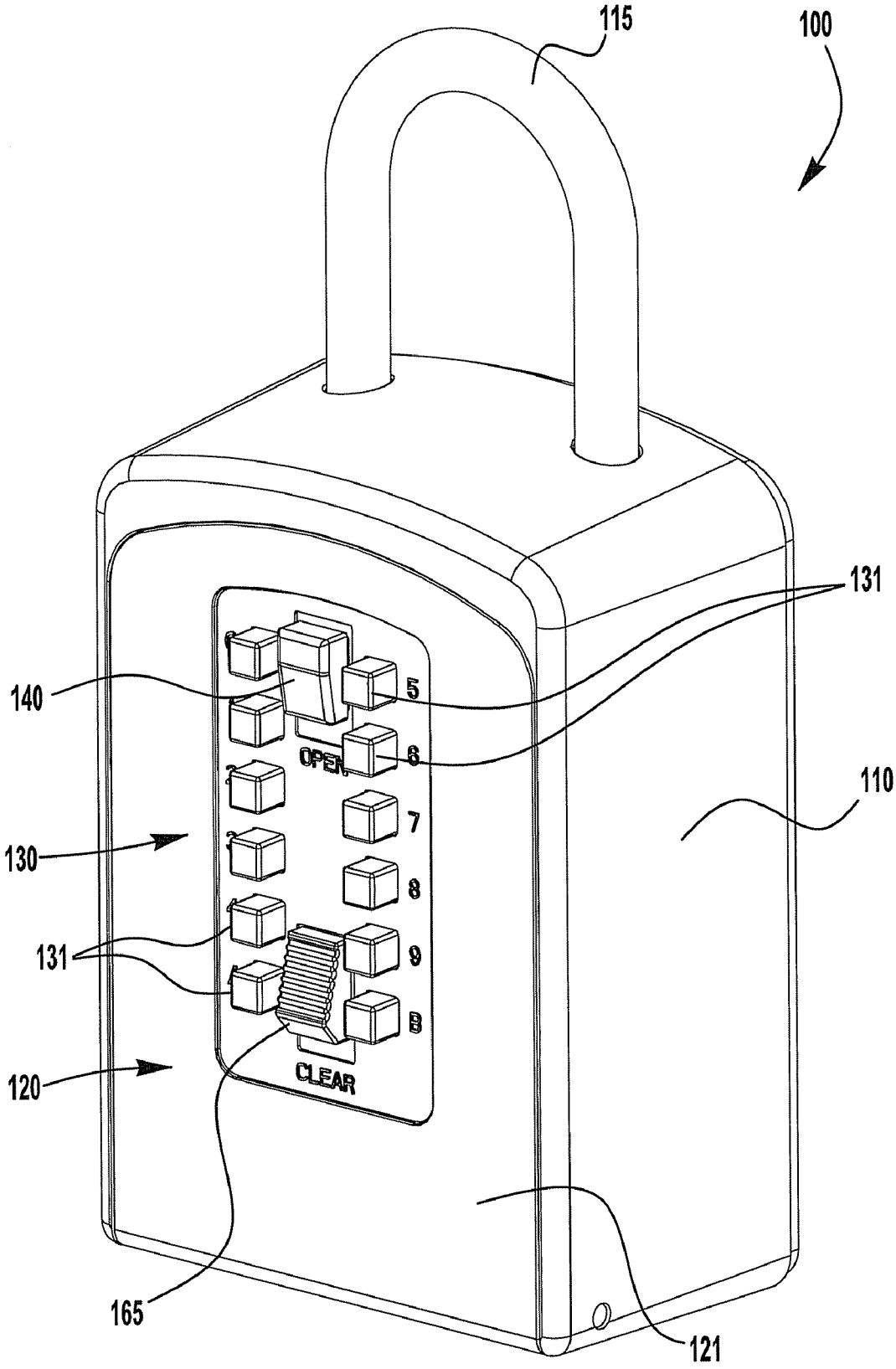
FIG. 1 is a perspective view of a pushbutton-operated lockable enclosure.

This Detailed Description of the Invention merely describes embodiments of the invention and is not intended to limit the scope of the claims in any way. Indeed, the invention as claimed is broader than and unlimited by the preferred embodiments, and the terms used in the claims have their full ordinary meaning.

Also, while the exemplary embodiments described in the specification and illustrated in the drawings relate to a mechanical pushbutton safe or lock box sized to store smaller items, such as door keys, it should be understood that many of the inventive features described herein may be applied to other sizes and types of lockable enclosures, including, for example, larger safes and cash boxes, and lockable enclosures utilizing combination dials, key-operated locking mechanisms, and electromechanical locking mechanisms. Further, many of the inventive features described herein may also be applied to other types of locking arrangements, including, for example, padlocks, door locks, and safety lockout devices.

In an embodiment of the present application, as shown in FIG. 1-8, a lockable enclosure 100 (e.g., a key safe) includes a housing 110 and an access door 120 having a door member 121 securable to the housing 110 to block access to one or more cavities within the housing 110, in which one or more items may be securely stored. While the housing 110 may be formed from several components, in the illustrated embodiment, the housing 110 is a single piece structure, thereby eliminating potential weak points at seams between assembled components.

Figure 1A:
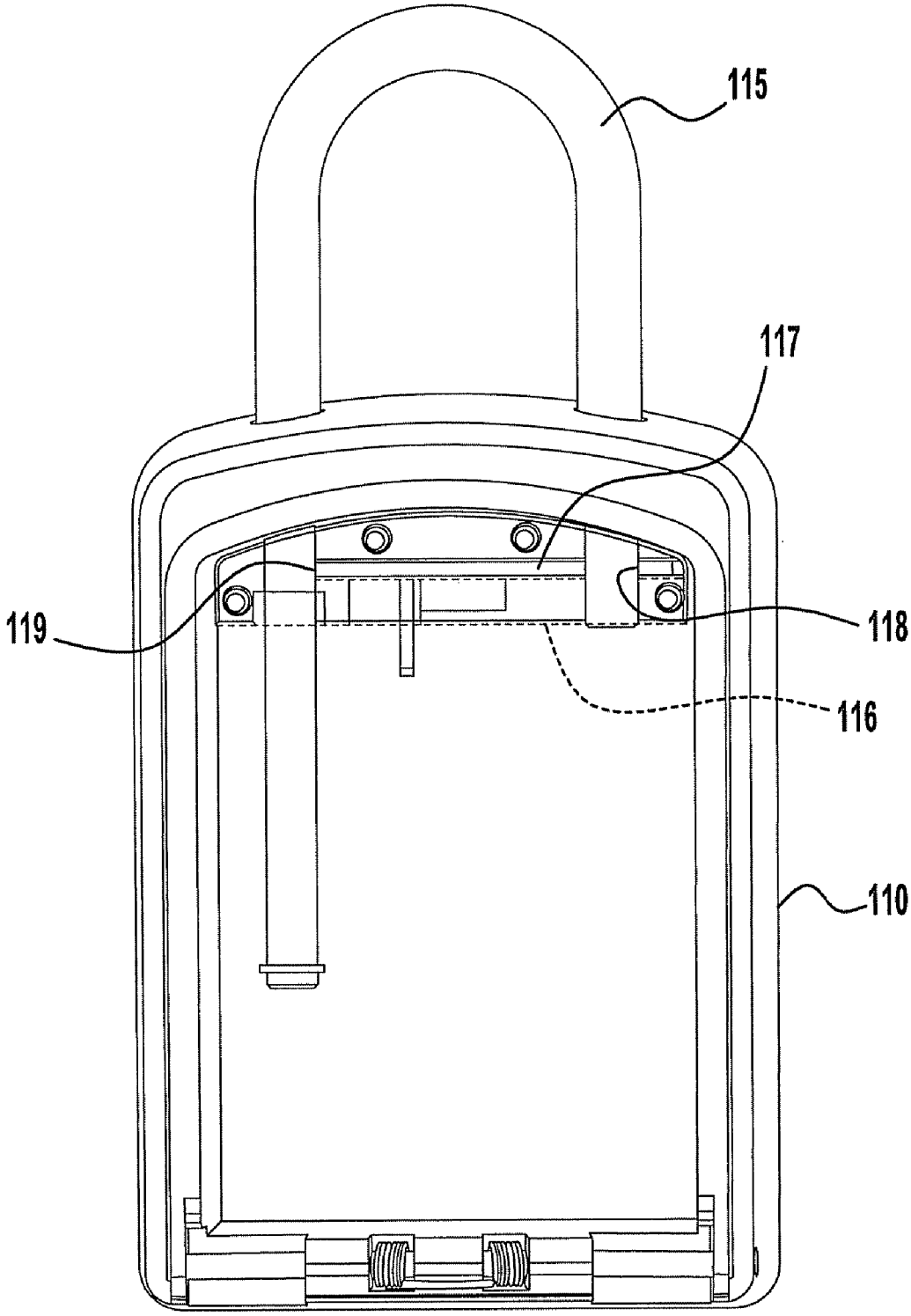
FIG. 1A is a front view of the lockable enclosure of FIG. 1, with the access door removed to illustrate additional features of the enclosure.
Figure 2:
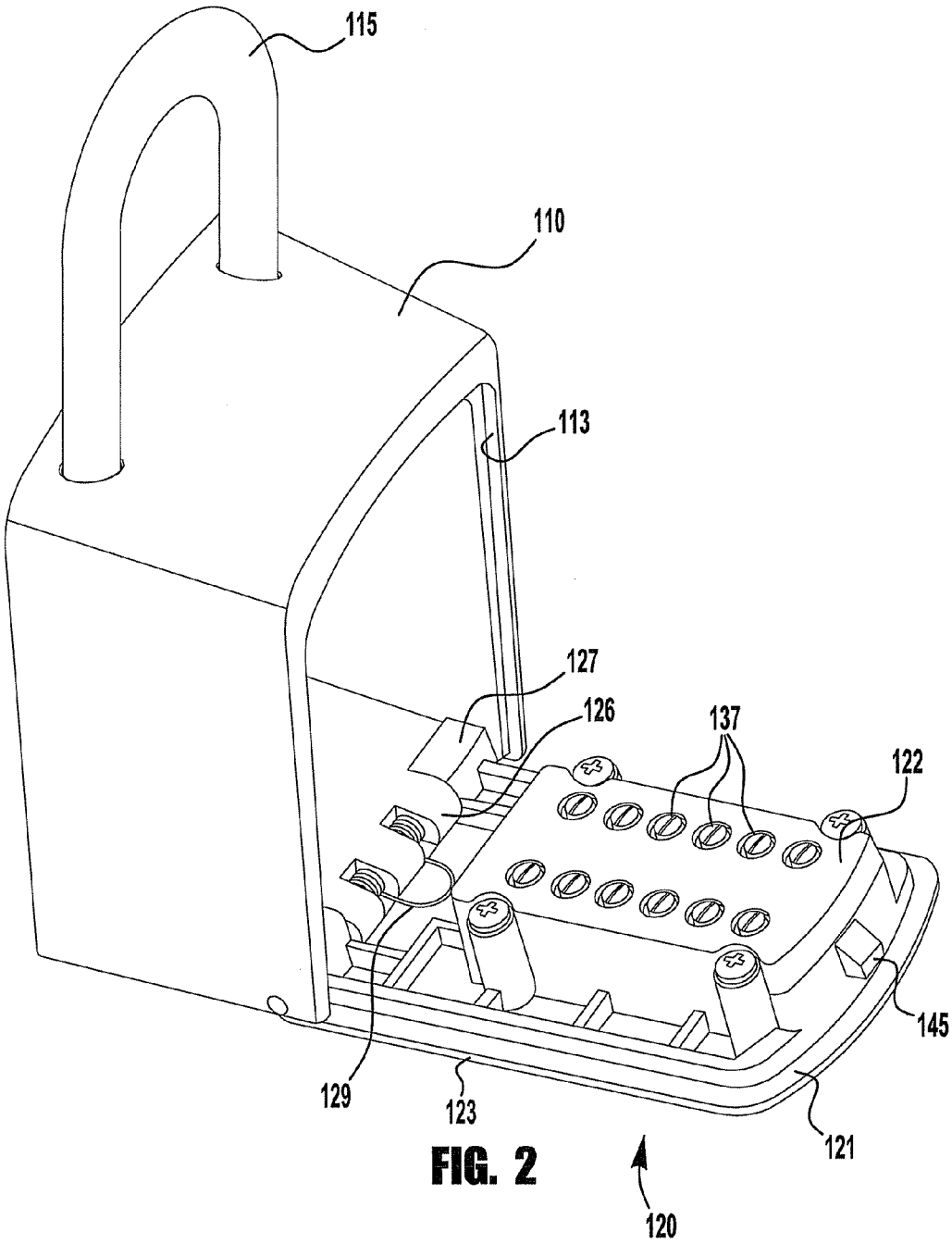
FIG. 2 is a side perspective view of the lockable enclosure of FIG. 1, shown with the access door in the open position.
Figure 3:
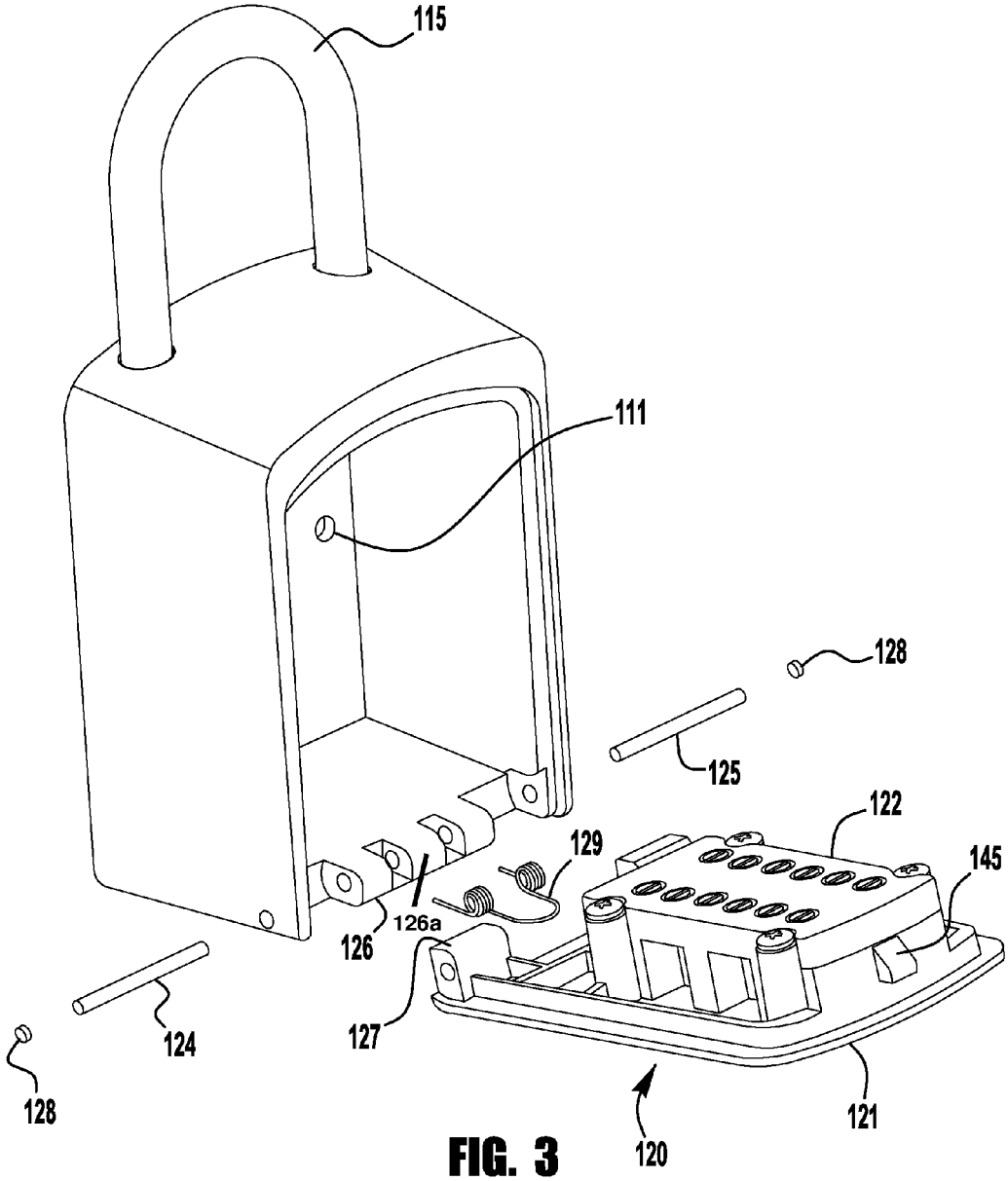
FIG. 3 is a partially exploded perspective view of the lockable enclosure of FIG. 1.

Many different arrangements may be utilized to secure the lockable enclosure 100 to an external structure, such as, for example, a door or a wall. The exemplary housing 110 includes mounting holes 111 (see FIG. 3) in a rear wall for securing the enclosure 100 to a structure (for example, using fasteners) while blocking access to the fasteners when the access door is closed. Additionally or alternatively, the lockable enclosure 100 may also be provided with a shackle 115 to secure the enclosure 100 to a structure (e.g., around the base of a doorknob). Many different locking arrangements may be provided to secure the shackle in a closed or retracted condition, to prevent theft or removal of the enclosure. In the illustrated embodiment, as shown in FIG. 1A, a manually operable release lever 117 is accessible inside the housing 110 when the access door 120 is opened. The release lever 117 is slideable within a shackle release block 116 to align cutouts 118, 119 in the lever 117 with the shackle legs to allow withdrawal of the shackle 115. When the release lever is in a normal shackle retaining position, the lever 117 interlocks with notches (not shown) in the shackle legs.

The lockable enclosure 100 includes a locking mechanism with a lock interface 130 that is manipulable by a user to unlock the locking mechanism for movement of the access door 120 to an open position, for access to the contents of the enclosure 100. While many different lock interfaces may be utilized (including, for example, combination dials, keyways, and electronic keypads and sensors), in the illustrated embodiment, the lock interface 130 includes a set of mechanical pushbuttons 131, extending from the door member 121, that may be selectively pressed by a user for entry of an authorized combination code to unlock the locking mechanism.

The exemplary embodiment also includes a user operable opening member (e.g., a lever or button 140) that is operatively connected to a latch member 145 (see FIGS. 2-6) that engages a portion of the housing 110 to secure the access door 120 in the locked position. In the locked condition, the latch member 145 is blocked from disengaging from the housing 110. Entry of an authorized combination code on the lock interface 130 causes the locking mechanism to allow retraction of the latch member 145 by user movement of the opening button 140 from a normal position to an opening position to disengage the latch member 145 from the housing 110 for opening the access door 120. While the illustrated opening member 140 is a button slideable in a direction substantially parallel to the direction of movement of the latch member, other configurations may be utilized. For example, the opening member may be provided as a pushbutton, toggle switch, dial, or other such mechanism, with linkages or connections suitable to translate movement of the opening member to sliding movement of the latch member.

According to an inventive aspect of the present application, a connection between the opening button and the latch member may be configured to operatively isolate the opening button from the latch member to prevent an unauthorized forced opening of the lockable enclosure by attacking the opening button with excessive downward force. A separable rigid connection may be utilized (including, for example, a necked-down breakable connection or a limited strength adhesive connection) to disconnect an opening button from a latch before damage to other locking components allows for movement of the latch. However, such an arrangement may render the lockable enclosure inoperable for subsequent authorized entry attempts. In one inventive embodiment, an elastically compressible member (e.g., a biasing mechanism or spring member) may be used to operatively connect (either directly or indirectly) the opening button to the latch member to allow for movement of the opening button with respect to the latch member when the latch member is blocked. An opposed biasing mechanism or return spring may be used to hold the unblocked latch member in the latching or housing engaging position until user movement of the opening button occurs. When force is applied to the opening button without unlocking the locking mechanism (i.e., without unblocking the latch member), the opening button moves against the force or resistance of the compressible member to the opening position without damaging internal locking mechanism components, thereby preventing an unauthorized forced opening of the lockable enclosure by attacking the opening button with excessive downward force. When the locking mechanism has been unlocked (i.e., when the latch member has been unblocked), the second biasing member holds the latch member in a locked position until downward force is applied to the unblocked latch member (through the first biasing mechanism and against the second biasing mechanism) for movement of the latch member out of engagement with the housing. To maintain an operative connection between the opening button and the latch member when the locking mechanism is in the unlocked condition, the compressible may be provided with a greater resistance to compression (e.g., rigidity or spring strength) than the return spring or second biasing mechanism.

Figure 4:
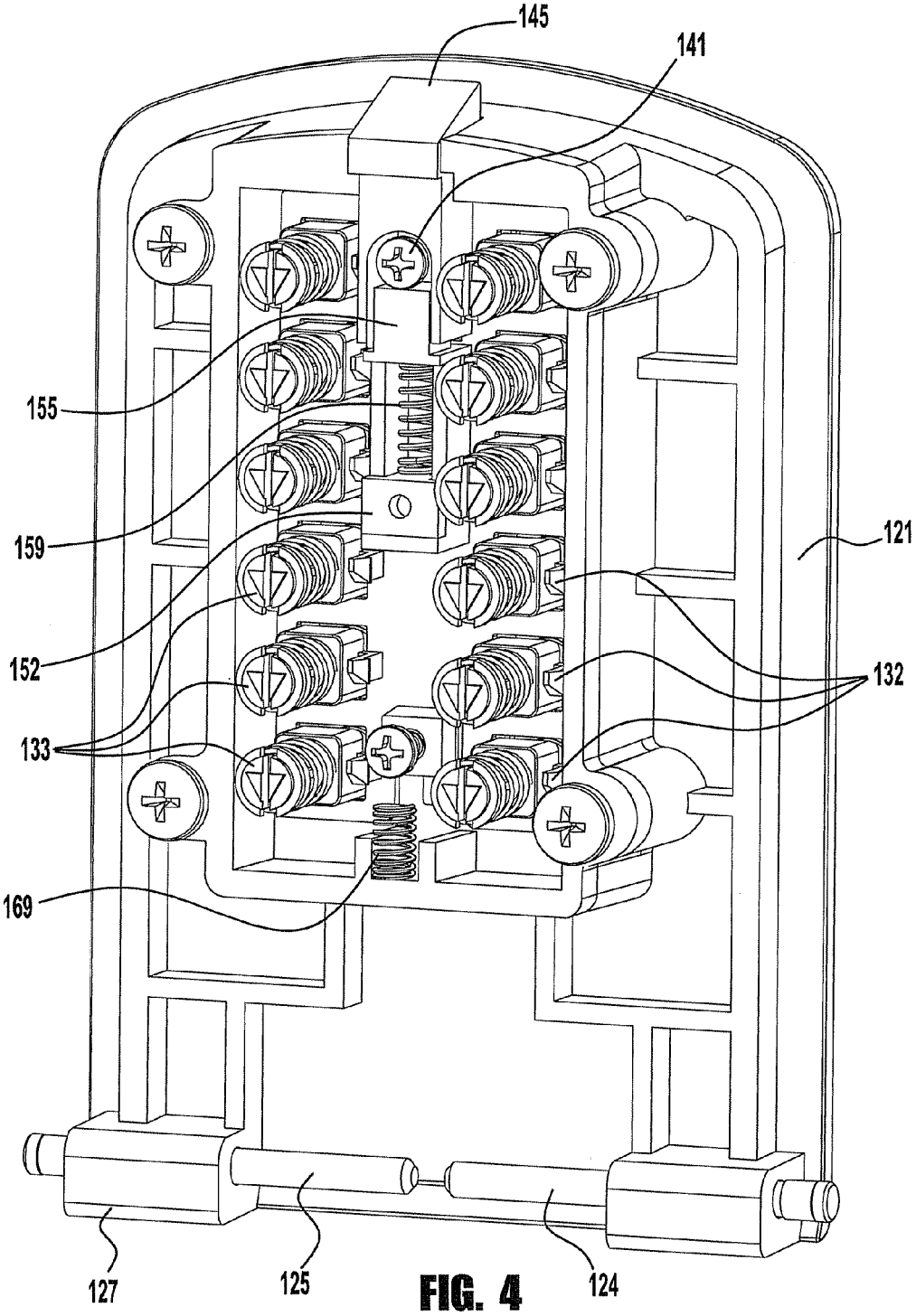
FIG. 4 is a rear perspective view of the access door of the lockable enclosure of FIG. 1.
Figure 5:
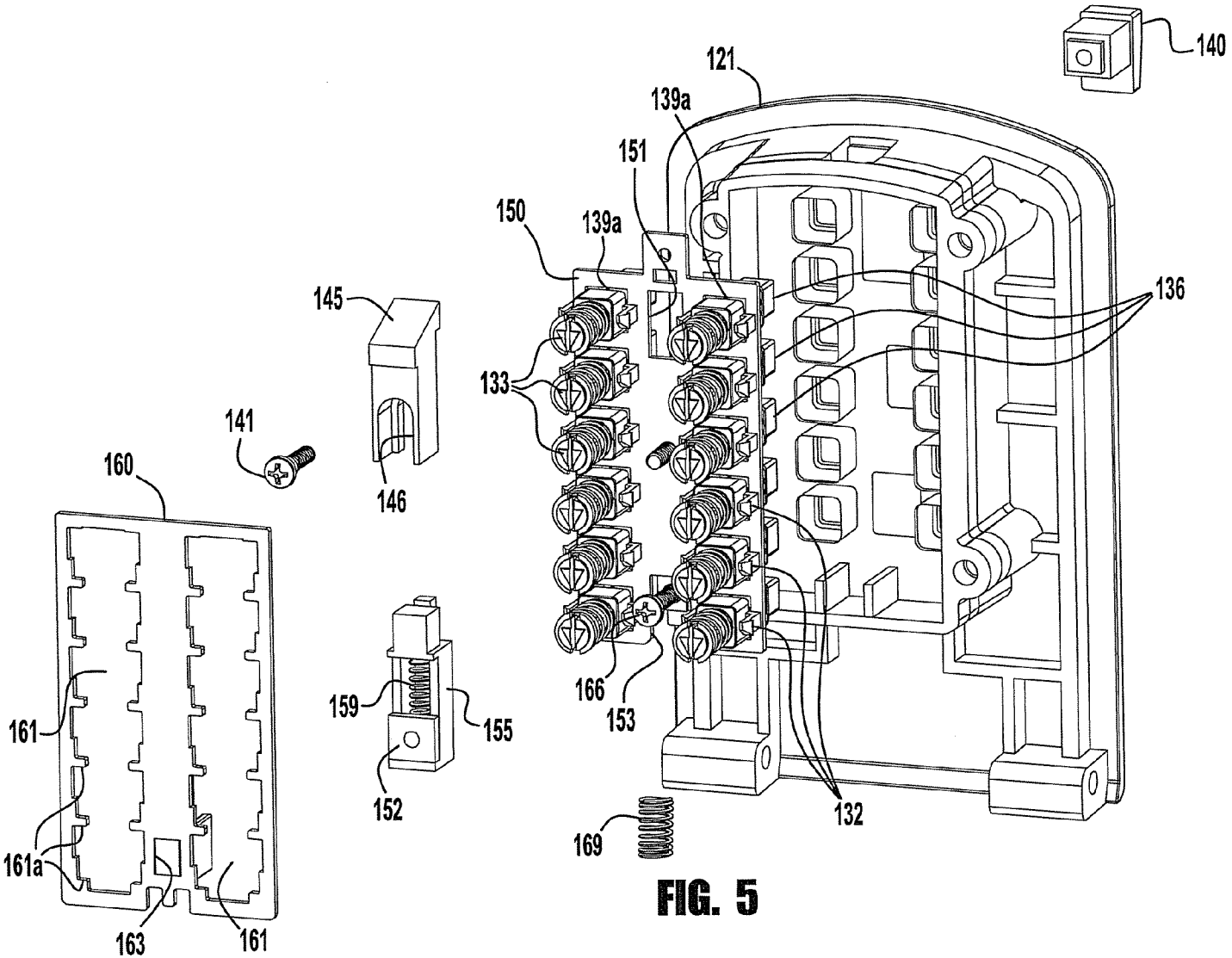
FIG. 5 is a rear exploded perspective view of the access door of the lockable enclosure of FIG. 1.
Figure 6:
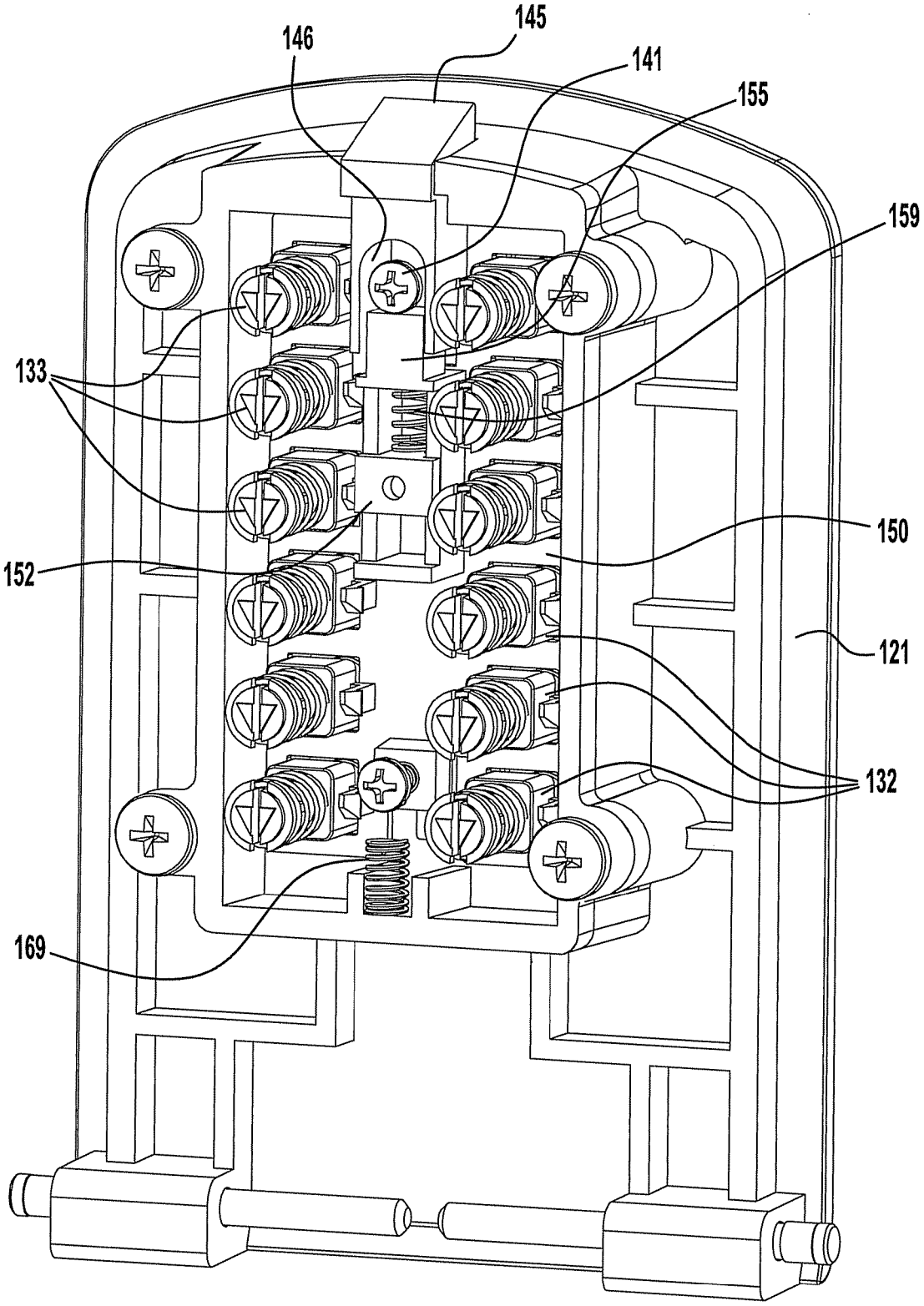
FIG. 6 is a rear perspective view of the access door of the lockable enclosure of FIG. 1, shown with the opening button in the opening position.
Figure 7:
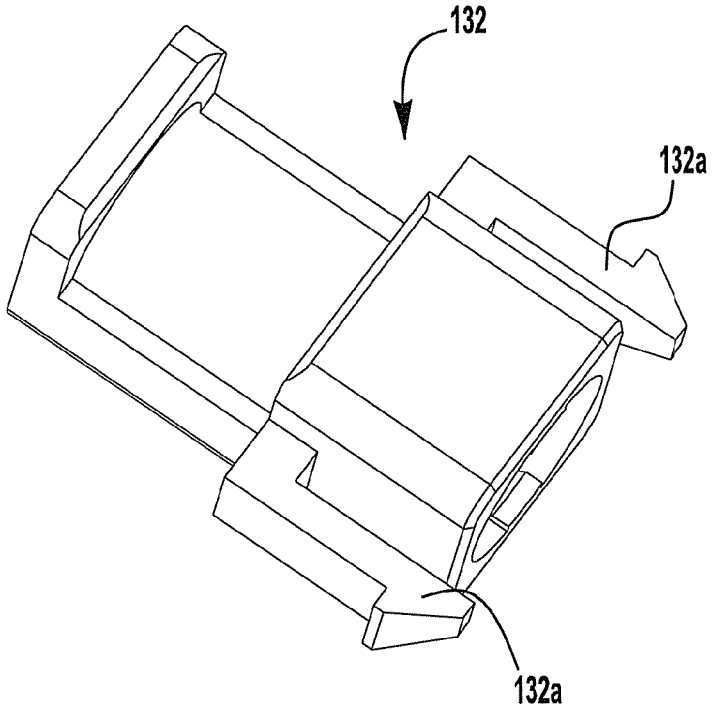
FIG. 7 is a perspective view of a button body of the lockable enclosure of FIG. 1.
Figure 8:
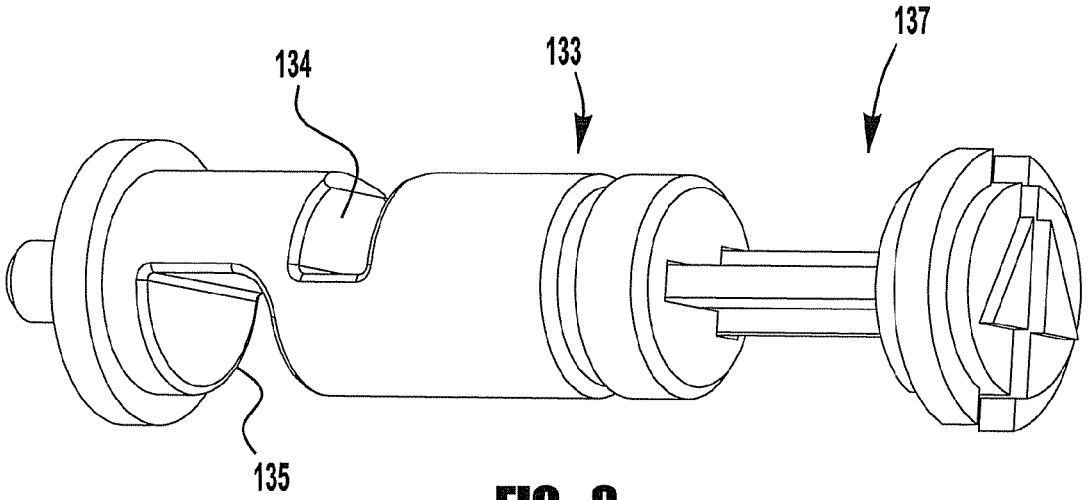
FIG. 8 is a perspective view of a button pin of the lockable enclosure of FIG. 1.

Many different configurations may be utilized to provide a separable connection between an opening button and latch member of a lockable enclosure. In the illustrated embodiment, as shown in FIGS. 4-6, the opening button 140 includes a screw 141 (or other suitable extension) that extends through a recessed slot 146 in the latch member 145 and a slot 151 in a latch plate 150. The latch member 145 and latch plate 150 are joined together to form a latch assembly, for example, by a post on the latch member pressed through an opening (not shown) in the latch plate 150, or by some other assembly, or as an integral component. The latch plate 150 is blocked from movement when the locking mechanism is in a locked condition, thereby holding the latch member 145 in engagement with the housing 110. When the locking mechanism is unlocked, the latch plate 150 is unblocked and free to move to disengage the latch member 145 from the housing 110.

As shown in FIG. 6, when movement of the latch member 145 and latch plate 150 is blocked (i.e., when the locking mechanism has not been unlocked), force applied to the opening button 140 moves the screw 141 within the recessed slot 146 and the opening 151 and against a spring biased guide 155 to move the guide 155 against spring member 159 and toward a post 152 or other such projection affixed to the latch plate 150. Thus, full movement of the opening button 140 of the locked enclosure 100 is freely permitted, without damaging the locking mechanism and without moving the latch member 145. When the locking mechanism has been unlocked or properly manipulated to unblock movement of the latch member 145 and latch plate 150, movement of the opening button 140 applies a force to the post 152 (through the screw 141, guide 155, and spring 159) to move the latch plate 150 and joined latch member 145 against a return spring 169 (or other suitable biasing mechanism) for movement of the latch member 145 out of engagement with the housing 110.

Figure 5A:
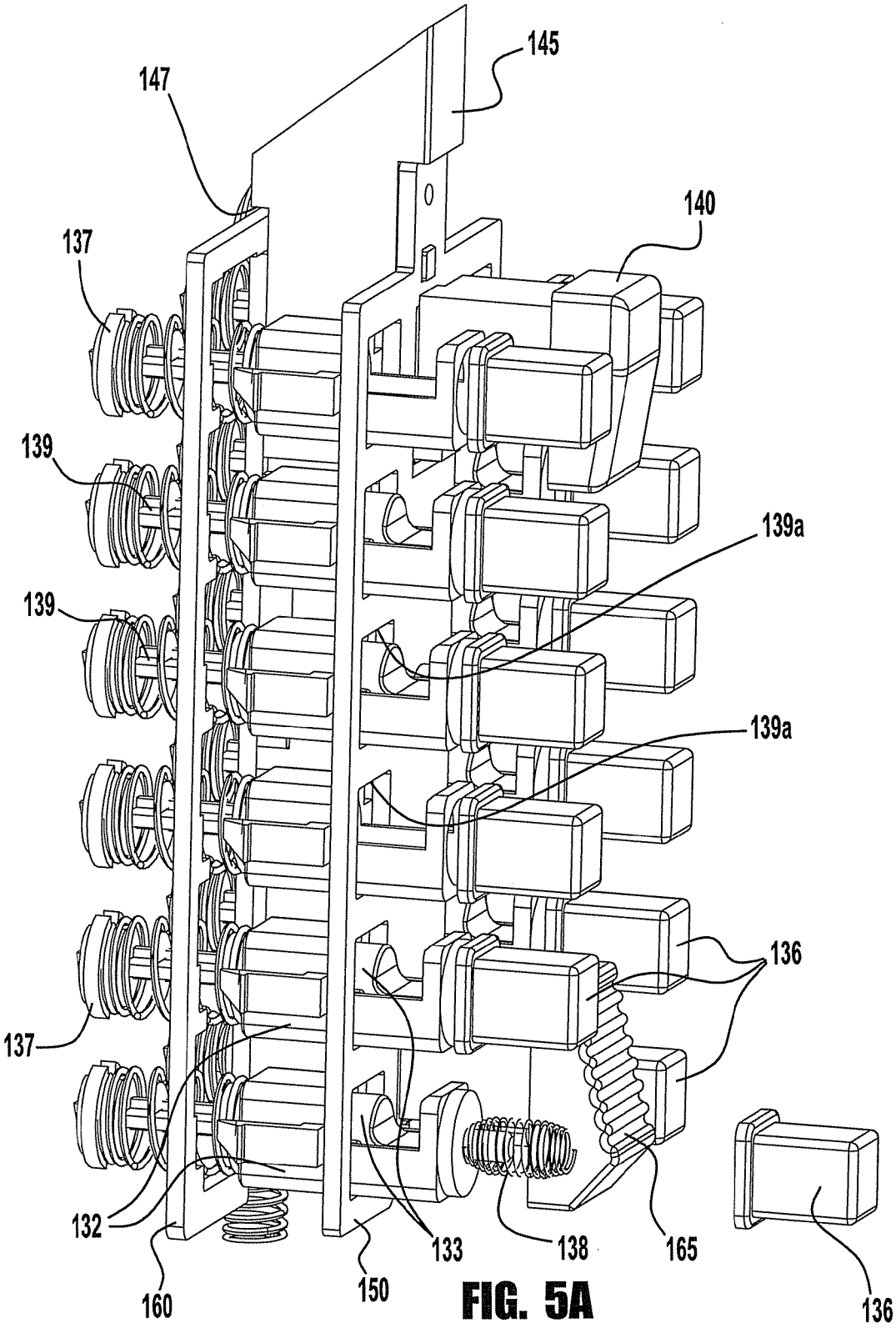
FIG. 5A is a side perspective view of a pushbutton and locking mechanism subassembly of the lockable enclosure of FIG. 1.

Many different types of locking mechanisms may be utilized to selectively allow movement of a latch member out of engagement with a locking enclosure housing to open an access door. In the illustrated embodiment, as shown in FIGS. 4-6, each of the pushbuttons 131 includes a button pad 136 assembled with button body 132 (see FIG. 7) and a notched button pin 133 (see FIG. 8) received through corresponding openings 139 in a latch plate 150. As shown in FIG. 5A, the button pads 136 may be spring biased outward from pins 133 by springs 138, for example, to provide a uniform appearance between pressed and unpressed buttons 131. Each button body 132 is spring-loaded by a spring 139 toward an unpressed position. When a pushbutton 131 is pressed against this spring bias, outward biased fingers 132*a* on the button body 132 interlock with side tab portions 161*a* of a corresponding opening 161 in a code clearing plate 160, to hold the button body 132 in a pressed position. Each notched pin 133 is rotatable from the rear side of the door by a user manipulable portion 137 (e.g., by a screwdriver-engageable slot or other such feature) extending from door cover 122, see FIGS.

2 and 3, between a non-selected orientation and a selected orientation. In the non-selected orientation, a first notch 134 aligns with an adjacent edge 139*a* (see FIGS. 5 and 5*a*) of the corresponding latch plate opening 139 when the button body 132 is in the unpressed position. In the selected orientation, a second notch 135 aligns with the latch plate opening edge 139*a* when the button body 132 is in the pressed position. When the "selected" button bodies 132 are all in the pressed position and the "non-selected" button bodies 132 are all in the unpressed position, the corresponding first and second notches 134, 135 align with the corresponding latch plate opening edges 139*a* to unblock the latch plate 150 and latch member 145. In this configuration, the latch plate 150 is movable against return spring 169 (through code clearing plate 160, as described in greater detail below) and into engagement with the aligned first and second notches 134, 135 to disengage the latch member 145 from the housing 110 for movement of the access door 120 to the open position.

The illustrated embodiment is provided with twelve pushbuttons 131 each labeled with different alphanumeric identifiers to provide for $2^{12}$ or 4,096 possible authorized combination codes. It is to be understood that a lockable enclosure with more or fewer authorized combination codes may be provided for by providing a pushbutton locking mechanism with more or fewer buttons.

While the latch plate and latch member may be connected with the code clearing plate 160 in many different ways, in the illustrated embodiment, the latch member 145 includes a laterally extending lip 147 that overhangs a top edge of the code clearing plate 160, such that retraction of the latch member 145 moves the code clearing plate 160 against the return spring 169. This movement of the code clearing plate 160 causes the button body fingers 132*a* to disengage from the corresponding side tab portions 161*a* of the code clearing plate 160, allowing the pressed button bodies 132 to spring bias back to the unpressed position, thereby "clearing" the entered code when the opening button 140 is released. To re-close the access door 120, the selected pushbuttons 131 associated with the authorized code are pressed again to allow for retraction of the latch member by pressing the opening button 140. Once the access door 120 is re-closed and the opening button 140 is released, the latch member 145 extends again for locking engagement with the housing 110.

The lockable enclosure may also be configured to allow the pressed buttons to be reset, for example, when an incorrect button is accidentally pressed. In the exemplary embodiment, a slideable clearing button 165 extends from the front of the access door 120 and includes an extension 166 (FIG. 5) passing through a notch 153 in the latch plate 150 to engage an opening 163 in the code clearing plate 160. When the clearing button 165 is pushed, the extension 166 forces the code clearing plate 160 against return spring 169 to disengage the button body fingers 132*a* from the corresponding side tab portions 161*a* of the code clearing plate 160, allowing the pressed button bodies 132 to spring bias back to the unpressed position, thereby "clearing" the entered code.

Still other inventive features may be provided with a lockable enclosure in accordance with various aspects of the present application. For example, while the access door may be provided as a separate, removable door, in the illustrated embodiment, the access door 120 is hingedly connected to the housing 110 for pivotable movement of the access door 120 between the closed and open positions. As shown, an outer edge 123 of the door 120 may be received in a peripheral recess 113 in the housing 110, such that the closed door 120 is substantially flush with the front of the housing 110. The access door hinge may include opposed hinge pins 124, 125 (as opposed to a single hinge pin) inserted through corresponding hinge portions 126, 127 of the housing 110 and access door 120, with the openings in the housing 110 being blocked by corresponding hinge plugs 128. The dual hinge pins 124, 125 may be separated by a solid portion 126*a* of the housing hinge 126 (see FIG. 3), to impede separation of the hinge portions 126, 127, for example, by peening the hinge pins out of the hinge portions (which may be a vulnerability of a single hinge pin design). Further, the access door 120 may be spring biased at the hinge portions 126, 127, for example, by a torsion spring 129, such that the access door 120 automatically opens when the opening button 145 of the unlocked enclosure 100 is moved to the opening position. As shown, the torsion spring 129 may be assembled with the hinge pins 124, 125 such that the torsion spring 129 is not removable without removal of the hinge pins 124, 125.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

What is claimed is:

1. A lockable enclosure comprising:

a housing;

an access door securable to the housing to block access to one or more cavities within the housing;

a latch assembly assembled with the access door and movable with respect to the access door between a housing engaging position for securing the access door in a closed position and a housing disengaging position for allowing movement of the access door to an open position;

a locking mechanism configured to hold the latch assembly in the housing engaging position when the locking mechanism is in a locked condition and to allow the latch assembly to move to the housing disengaging position when the locking mechanism is in an unlocked condition; and a user operable opening button disposed on the access door and slideable in a direction substantially parallel to a direction of movement of the latch assembly from a normal position to an opening position, wherein when the locking mechanism is in the unlocked condition, movement of the opening button to the opening position moves the latch assembly from the housing engaging position to the housing disengaging position;

wherein the opening button is operatively connected to the latch assembly by a spring member, such that when the locking mechanism is in the locked condition, movement of the opening button toward the opening position compresses the spring member without moving the latch assembly out of the housing engaging position.

2. The lockable enclosure of claim 1, wherein the locking mechanism comprises a set of mechanical pushbuttons disposed on the access door for entry of an authorized combination code to unlock the locking mechanism.

3. The lockable enclosure of claim 1, wherein the locking mechanism is configured to block movement of the latch assembly out of the housing engaging position when the locking mechanism is in the locked condition.

4. The lockable enclosure of claim 1, further comprising a return spring that biases the latch assembly toward the housing engaging position.

5. The lockable enclosure of claim 4, wherein the spring member has a spring strength that is greater than a spring strength of the return spring.

6. The lockable enclosure of claim 1, wherein the access door is hingedly connected to the housing at a hinge portion.

7. The lockable enclosure of claim 6, wherein the hinge portion includes first and second opposed hinge pins separated by a solid portion of the housing.

8. The lockable enclosure of claim 6, wherein the hinge portion includes a torsion spring that biases the access door toward the open position.

9. The lockable enclosure of claim 1, further comprising a guide member for retaining the spring member, the guide member including a first end portion in driven engagement with the opening button and a second end portion that engages the latch assembly to limit spring biased movement of the guide member.

10. A locking arrangement comprising:

a latch assembly movable between a latching position and an unlatching position;

a locking mechanism configured to hold the latch assembly in the latching position when the locking mechanism is in a locked condition and to allow the latch assembly to move to the unlatching position when the locking mechanism is in an unlocked condition; and a user operable opening button slideable in a direction substantially parallel to a direction of movement of the latch assembly from a normal position to an opening position, wherein when the locking mechanism is in the unlocked condition, movement of the opening button to the opening position moves the latch assembly from the latching position to the unlatching position;

wherein the opening button is operatively connected to the latch assembly by a spring member, such that when the locking mechanism is in the locked condition, movement of the opening button toward the opening position compresses the spring member without moving the latch assembly out of the latching position.

11. The locking arrangement of claim 10, further comprising a return spring that biases the latch assembly toward the latching position.

12. The locking arrangement of claim 11, wherein the spring member has a spring strength that is greater than a spring strength of the return spring.

13. The locking arrangement of claim 10, further comprising a guide member for retaining the spring member, the guide member including a first end portion in driven engagement with the opening button and a second end portion that engages the latch assembly to limit spring biased movement of the guide member.

14. A key safe comprising:

a housing;

an access door hingedly connected to the housing at a hinge portion to block access to one or more cavities within the housing in a closed position and to allow access to the one or more cavities in an open position;

a latch member assembled with the access door and movable with respect to the access door between a housing engaging position for securing the access door in a closed position and a housing disengaging position for allowing movement of the access door to an open position;

a latch plate secured to the latch member for movement therewith;

a return spring assembled with the access door for biasing the latch plate and latch member toward the housing engaging position;

a locking mechanism configured to hold the latch member and latch plate in the housing engaging position when the locking mechanism is in a locked condition and to allow the latch member and latch plate to move to the housing disengaging position when the locking mechanism is in an unlocked condition;

a user operable opening button disposed on the access door and slideable within a slot in the latch plate from a normal position to an opening position, wherein when the locking mechanism is in the unlocked condition, movement of the opening button to the opening position moves the latch member from the housing engaging position to the housing disengaging position;

a guide member assembled with the latch plate and including a first end portion in driven engagement with the opening button and a second end portion that engages a projection on the latch plate; and a spring member having a first end that engages the first end portion of the guide member and a second end that engages the latch plate projection to provide a compressible connection between the opening button and the latch plate, such that when the locking mechanism is in the locked condition, movement of the opening button to the opening position compresses the spring member without moving the latch member and latch plate out of the housing engaging position.

15. The key safe of claim 14, wherein the locking mechanism comprises a set of mechanical pushbuttons assembled with the access door and movable between pressed and unpressed positions, with each pushbutton extending through a corresponding opening in the latch plate, wherein when only a predetermined one or more of the set of pushbuttons is in the pressed position, notches in the pushbuttons align with the latch plate to permit movement of the latch plate and the latch member from the housing engaging position to the housing disengaging position.

16. The key safe of claim 14, wherein the opening button is slideable in a direction substantially parallel to a direction of movement of the latch member.

17. The key safe of claim 14, wherein the spring member has a spring strength that is greater than a spring strength of the return spring.

18. The key safe of claim 14, wherein the hinge portion includes first and second opposed hinge pins separated by a solid portion of the housing.

* * * * *